US010451278B2

(12) United States Patent
Pidcock et al.

(10) Patent No.: US 10,451,278 B2
(45) Date of Patent: Oct. 22, 2019

(54) COMBUSTION CHAMBER HAVING AXIALLY EXTENDING AND ANNULAR COOLANT MANIFOLDS

(71) Applicant: ROLLS-ROYCE plc, London (GB)

(72) Inventors: Anthony Pidcock, Derby (GB); Paul I. Chandler, Birmingham (GB)

(73) Assignee: ROLLS-ROYCE plc, London (GB)

( * ) Notice: Subject to any disclaimer, the term of this patent is extended or adjusted under 35 U.S.C. 154(b) by 745 days.

(21) Appl. No.: 14/992,300

(22) Filed: Jan. 11, 2016

(65) Prior Publication Data

US 2016/0230994 A1 Aug. 11, 2016

(30) Foreign Application Priority Data

Feb. 6, 2015 (GB) ..... 1501971.4

(51) Int. Cl.
*F23M 5/08* (2006.01)
*F23R 3/00* (2006.01)
(Continued)

(52) U.S. Cl.
CPC ..... *F23R 3/002* (2013.01); *F23M 5/08* (2013.01); *F23R 3/007* (2013.01); *F23R 3/06* (2013.01);
(Continued)

(58) Field of Classification Search
CPC .. F23R 3/002; F23R 3/06; F23R 2900/03042; F23R 2900/03043; F23R 2900/03044;
(Continued)

(56) References Cited

U.S. PATENT DOCUMENTS 4,339,925 A 7/1982 Eggmann et al.
5,363,654 A * 11/1994 Lee ..... F23R 3/002 165/908
(Continued)

FOREIGN PATENT DOCUMENTS

GB 2086031 A 5/1982
GB 2356042 A 5/2001
(Continued)

OTHER PUBLICATIONS

Jun. 29, 2015 British Search Report issued in British Patent Application No. 1501971.4.
(Continued)

*Primary Examiner* — Alain Chau
(74) *Attorney, Agent, or Firm* — Oliff PLC

(57) ABSTRACT

A lean burn combustor includes a first wall and a second wall spaced from the first annular wall. Angularly spaced axially extending coolant collection manifolds collect coolant from the space between the first and second walls. A plurality of rows of axially spaced apertures extend through the first wall to supply coolant into the space between the first and second walls and one row of aperture is positioned between each pair of adjacent manifolds. The second wall extends the full length of the combustor. The second wall has a circumferentially extending wall extending towards and contacting the first wall and the wall is spaced from the downstream end of the second wall. An annular supply manifold supplies coolant to the space between the first and second walls downstream of the circumferentially extending wall and the manifolds supply coolant to the manifold. A film of coolant is discharged from the space.

24 Claims, 5 Drawing Sheets

(51) Int. Cl.
*F23R 3/06* (2006.01)
*F23R 3/54* (2006.01)

(52) U.S. Cl.
CPC ..... *F23R 3/54* (2013.01); *F05D 2260/22141* (2013.01); *F23R 2900/03042* (2013.01); *F23R 2900/03043* (2013.01); *F23R 2900/03044* (2013.01); *F23R 2900/03045* (2013.01)

(58) Field of Classification Search
CPC .. F23R 2900/03045; F23R 3/007; F23R 3/54; F23R 2900/03041; F05D 2260/201; F05D 2260/202; F05D 2260/205; F05D 2260/221; F05D 2260/22141; F05D 2240/35; F23M 5/08; F23M 5/085
See application file for complete search history.

(56) References Cited

U.S. PATENT DOCUMENTS 5,467,815 A * 11/1995 Haumann ..... F01P 1/02 165/109.1
5,647,202 A 7/1997 Althaus
5,737,922 A * 4/1998 Schoenman ..... F23R 3/002 165/168
6,047,552 A * 4/2000 Gross ..... F23R 3/002 165/908
6,173,561 B1 * 1/2001 Sato ..... F02C 7/18 60/752
6,276,142 B1 * 8/2001 Putz ..... F23M 5/02 60/752
6,536,201 B2 3/2003 Stuttaford et al.
2002/0066273 A1 6/2002 Kitamura et al.
2004/0118123 A1 6/2004 Tiemann
2010/0170260 A1 * 7/2010 Mawatari ..... F23R 3/005 60/755
2010/0251722 A1 10/2010 Woolford et al.
2011/0232299 A1 * 9/2011 Stryapunin ..... F23R 3/04 60/806
2013/0055722 A1 3/2013 Verhiel et al.

FOREIGN PATENT DOCUMENTS

GB 2441342 A 3/2008
WO 9714875 A1 4/1997
WO WO-9714875 A1 * 4/1997 ..... F02C 7/224

OTHER PUBLICATIONS

Jun. 27, 2016 European Search Report issued in European Patent Application No. 16 15 0784.

* cited by examiner

COMBUSTION CHAMBER HAVING AXIALLY EXTENDING AND ANNULAR COOLANT MANIFOLDS

FIELD OF THE INVENTION

The present disclosure relates to a combustion chamber and in particular to a gas turbine engine combustion chamber.

BACKGROUND TO THE INVENTION

Gas turbine engine annular combustion chambers comprise an inner annular wall structure, an outer annular wall structure and an annular upstream end wall structure. The annular upstream end wall structure comprises an annular head and a plurality of heat shields. The heat shields are positioned downstream of the annular head and are secured to the annular head. The inner annular wall structure comprises an annular wall and a plurality of rows of tiles and the tiles are positioned radially outwardly of the annular wall and are secured to the annular wall. The outer annular wall structure comprises an annular wall and a plurality of rows of tiles and the tiles are positioned radially inwardly of the annular wall and are secured to the annular wall.

The heat shields are provided with pedestals on their upstream surfaces and/or have effusion cooling apertures extending there-through to provide further cooling of the heat shields. The tiles on the inner annular wall structure are provided with pedestals on their radially inner surfaces and the downstream ends of the tiles in one row of tiles overlaps the upstream ends of the tiles in an adjacent row of tiles. Coolant is supplied through the annular wall to the space between the annular wall and the tiles so that the pedestals are cooled by the coolant and coolant is discharged from the downstream ends of one row of tiles to form a film of coolant on the radially outer surfaces of the tiles for further cooling of the tiles in the adjacent row of tiles. The tiles on the outer annular wall structure are provided with pedestals on their radially outer surfaces and the downstream ends of the tiles in one row of tiles overlaps the upstream ends of the tiles in an adjacent row of tiles. Coolant is supplied through the annular wall to the space between the annular wall and the tiles so that the pedestals are cooled by the coolant and coolant is discharged from the downstream ends of one row of tiles to form a film of coolant on the radially outer surfaces of the tiles for further cooling of the tiles in the adjacent row of tiles. The heat shield and tiles may also be provided with a thermal barrier coating on their surfaces facing and exposed to the hot combustion gases.

These tiles have been used extensively on rich burn combustion chambers and are able to withstand temperatures of over 2600K. This type of tiles relies on the combination of heat removal from the cold side of the tile, via the pedestals, hot side protection by the film of coolant and the thermal barrier coating.

Lean burn combustion chambers are being developed to reduce emissions of nitrous oxides (NOx). Lean burn combustion chambers operate at temperatures much less than 2600K and typically operate at a temperature of about 2300K. It might be expected that the use of the above type of tile would be obvious for a wall of a lean burn combustion chamber.

However, as mentioned previously the above mentioned type of tile has a film of coolant on the hot side of the tile. The film of coolant is actually the coolant that has flowed over, passed between the pedestals on, the cold side of the tile. The coolant used to cool the tiles is air supplied from one or more of the compressors of the gas turbine engine. Unfortunately, the presence of the film of coolant, film of air, on the hot side of the tiles may quench the combustion reactions in a lean burn combustion chamber. This is particularly important at cruise conditions, of a gas turbine engine, when the flame temperature in the lean burn combustion chamber may be as low as 1800K. This quenching of the combustion reactions may result in combustion inefficiency and increased fuel burn for the gas turbine engine.

The situation may be remedied by modifying the combustion process, such as by scheduling extra fuel to the pilot combustion zone of the lean burn combustion chamber, by supplying more fuel to the pilot injector of the fuel injector, so that the pilot zone operates at a higher temperature and helps to consume any inefficiency in the main combustion zone of the lean burn combustion chamber. Unfortunately, the rescheduling of extra fuel to the pilot combustion zone of the lean burn combustion chamber, during cruise conditions of the gas turbine engine, also increases the emissions of nitrous oxides (NOx).

Therefore the present disclosure seeks to provide a novel combustion chamber which reduces or overcomes the above mentioned problem.

SUMMARY OF INVENTION

Accordingly the present disclosure provides a combustion chamber comprising a first annular wall and a second annular wall spaced radially from the first annular wall, a plurality of circumferentially spaced axially extending coolant collection manifolds to collect coolant from the space between the first annular wall and the second annular wall, a plurality of apertures extending through the first annular wall to supply coolant into the space between the first annular wall and the second annular wall, at least one aperture being positioned between each pair of circumferentially adjacent axially extending coolant collection manifolds, the second annular wall extending the full length of the combustion chamber, the second annular wall having a circumferentially extending wall extending towards and contacting the first annular wall, the circumferentially extending wall being positioned adjacent to and spaced from the downstream end of the second annular wall, an annular supply manifold to supply coolant to the space between the first annular wall and the second annular wall downstream of the circumferentially extending wall, the axially extending coolant collection manifolds being arranged to supply coolant to the annular supply manifold, and the space between the first annular wall and the second annular wall downstream of the circumferentially extending wall being arranged to discharge a film of coolant from the downstream end of the second annular wall.

A plurality of rows of axially spaced apertures extending through the first annular wall may be provided to supply coolant into the space between the first annular wall and the second annular wall and at least one row of axially spaced apertures being positioned between each pair of circumferentially adjacent axially extending coolant collection manifolds.

The first annular wall may be corrugated and having axially extending grooves and axially extending ridges, the grooves and ridges alternating circumferentially around the first annular wall, each groove in the first annular wall having a plurality of axially spaced apertures extending through the first annular wall to supply coolant into the space between the first annular wall and the second annular wall, each axially extending ridge defining a collection manifold to collect coolant from the space between the first annular wall and the second annular wall, the second annular wall having a first surface facing the first annular wall and a second surface facing away from the first annular wall, the second annular wall having a circumferentially extending wall extending from the first surface of the second annular wall towards and contacting the first annular wall, the first annular wall having a circumferentially extending ridge positioned adjacent to and spaced from the downstream end of the first annular wall, the circumferentially extending ridge being positioned downstream of the circumferentially extending wall, the circumferentially extending ridge defining an annular supply manifold to supply coolant to the space between the first annular wall and the second annular wall downstream of the circumferentially extending wall, the axially extending ridges intersecting the circumferentially extending ridge to supply coolant from the collection manifolds to the annular supply manifold.

A third annular wall may be positioned between the first annular wall and the second annular wall, the third annular wall abutting the first annular wall, the third annular wall having a plurality of apertures extending through the third annular wall and aligned with a corresponding aperture in the first annular wall to supply coolant into the space between the first annular wall and the second annular wall, the third annular wall defining the collection manifolds with the axially extending ridges of the first annular wall, the third annular wall having a plurality of apertures to supply coolant from the space between the first annular wall and the second annular wall into the collection manifolds, the third annular wall defining the annular supply manifold with the circumferentially extending ridge of the first annular wall and the third annular wall having a plurality of apertures to supply coolant from the annular supply manifold to the space between the first annular wall and the second annular wall downstream of the circumferentially extending wall.

The space between the first annular wall and the second annular wall downstream of the circumferentially extending wall may be arranged to discharge a film of coolant from the downstream end of the second annular wall onto a combustion chamber discharge nozzle.

The second annular wall may comprise a plurality of circumferentially arranged tiles and each tile has axially extending edge walls extending from the first surface of the second annular wall towards the first annular wall.

The axially extending edge walls of each tile may be circumferentially aligned with corresponding axially extending ridges on the first annular wall.

The centre of each tile may be aligned with an axially extending ridge on the first annular wall.

Each tile may have a plurality of studs to secure the tile to the first annular wall.

The tiles may be manufactured by casting or by additive layer manufacture.

The additive layer manufacture may comprise direct laser deposition or laser powder deposition.

Alternatively each tile may have apertures at the upstream end of the tile to secure the tile between the upstream end of the first annular wall and an upstream wall of the combustion chamber.

The downstream end of each tile may have a hook to locate in an annular slot in the first annular wall to secure the downstream end of the tile to the first annular wall.

The downstream end of each tile and the downstream end of the first annular wall may locate in an annular slot in a combustion chamber discharge nozzle.

The tiles may be manufactured by casting or by additive layer manufacture.

The additive layer manufacture may comprise direct laser deposition or laser powder deposition.

Alternatively the combustion chamber may comprise a plurality of circumferentially arranged segments, each segment comprising a portion of the first annular wall and a portion of the second annular wall, each segment has axially extending edge walls extending radially from the portion of the first annular wall to the portion of the second annular wall, the portion of the first annular wall and the portion of the second annular wall are integral and the segments are secured together.

The axially extending edge walls of each segment may be circumferentially aligned with the centres of corresponding axially extending ridges on the first annular wall to define two collections manifolds in each of the corresponding axially extending ridges.

The centre of each segment may be aligned with an axially extending ridge on the first annular wall.

The radially extending walls of each segment may extend radially beyond the ridge to form axially extending flanges and the flanges of adjacent segments are secured together.

The flanges of adjacent segments may be secured together with fasteners.

Each segment may have apertures at the upstream end of the segment to secure the segment to an upstream wall of the combustion chamber.

Each segment may be secured to the upstream wall of the combustion chamber with fasteners.

The downstream end of each segment may locate in an annular slot in a combustion chamber discharge nozzle.

The segments may be manufactured by additive layer manufacture.

The additive layer manufacture may comprise direct laser deposition or laser powder deposition.

The apertures in the first annular wall may be axially extending slots.

The second annular wall may have a plurality of pedestals extending from the first surface towards the first annular wall.

The pedestals may be circular in cross-section.

The first annular wall may be an inner annular wall of an annular combustion chamber and the second annular wall is spaced radially outwardly from the first annular wall.

Alternatively the first annular wall may be an outer annular wall of an annular combustion chamber and the second annular wall is spaced radially inwardly from the first annular wall.

The combustion chamber may be a lean burn combustion chamber comprising at least one lean burn fuel injector.

The combustion chamber may be a lean burn combustion chamber comprising a plurality of lean burn fuel injectors.

Each lean burn fuel injector may comprise a pilot fuel injector and a main fuel injector.

The combustion chamber may be a gas turbine engine combustion chamber. The gas turbine engine may be aero gas turbine engine, a marine gas turbine engine, an industrial gas turbine engine or an automotive gas turbine engine.

The aero gas turbine engine may be a turbofan gas turbine engine, a turbojet gas turbine engine, a turbo-shaft gas turbine engine or a turbo-propeller gas turbine engine.

A combustion chamber comprising a first wall and a second wall spaced radially from the first wall, a plurality of peripherally spaced longitudinally extending coolant collection manifolds to collect coolant from the space between the first wall and the second wall, a plurality of apertures extending through the first wall to supply coolant into the space between the first wall and the second wall, at least aperture being positioned between each pair of peripherally adjacent longitudinally extending coolant collection manifolds, the second wall extending the full length of the combustion chamber, the second wall having a peripherally extending wall extending towards and contacting the first wall, the peripherally extending wall being positioned adjacent to and spaced from the downstream end of the second annular wall, a peripheral extending supply manifold to supply coolant to the space between the first wall and the second wall downstream of the peripherally extending wall, the longitudinally extending coolant collection manifolds being arranged to supply coolant to the peripheral extending supply manifold, and the space between the first wall and the second wall downstream of the peripherally extending wall being arranged to discharge a film of coolant from the downstream end of the second annular wall.

BRIEF DESCRIPTION OF THE DRAWINGS

The present disclosure will be more fully described by way of example with reference to the accompanying drawings, in which.

DETAILED DESCRIPTION

Figure 1:
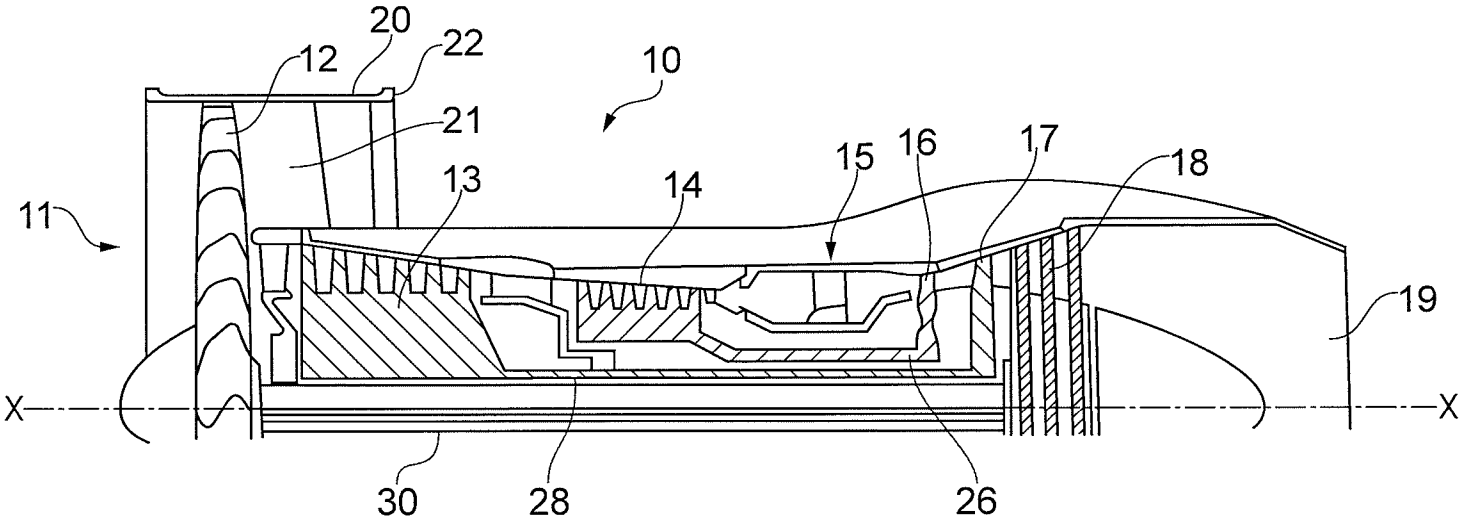
FIG. 1 is partially cut away view of a turbofan gas turbine engine having a combustion chamber according to the present disclosure.

A turbofan gas turbine engine 10, as shown in FIG. 1, comprises in flow series an intake 11, a fan 12, an intermediate pressure compressor 13, a high pressure compressor 14, a combustion chamber 15, a high pressure turbine 16, an intermediate pressure turbine 17, a low pressure turbine 18 and an exhaust 19. The high pressure turbine 16 is arranged to drive the high pressure compressor 14 via a first shaft 26. The intermediate pressure turbine 17 is arranged to drive the intermediate pressure compressor 13 via a second shaft 28 and the low pressure turbine 18 is arranged to drive the fan 12 via a third shaft 30. The fan 12 is arranged in a fan casing 20 which defines a fan duct 21 around the main engine and the fan duct 21 has a fan exhaust 22. In operation air flows into the intake 11 and is compressed by the fan 12. A first portion of the air flows through, and is compressed by, the intermediate pressure compressor 13 and the high pressure compressor 14 and is supplied to the combustion chamber 15. Fuel is injected into the combustion chamber 15 and is burnt in the air to produce hot exhaust gases which flow through, and drive, the high pressure turbine 16, the intermediate pressure turbine 17 and the low pressure turbine 18. The hot exhaust gases leaving the low pressure turbine 18 flow through the exhaust 19 to provide propulsive thrust. A second portion of the air bypasses the main engine and flows through the fan duct 21 and fan exhaust 22 to provide further propulsive thrust.

Figure 2:
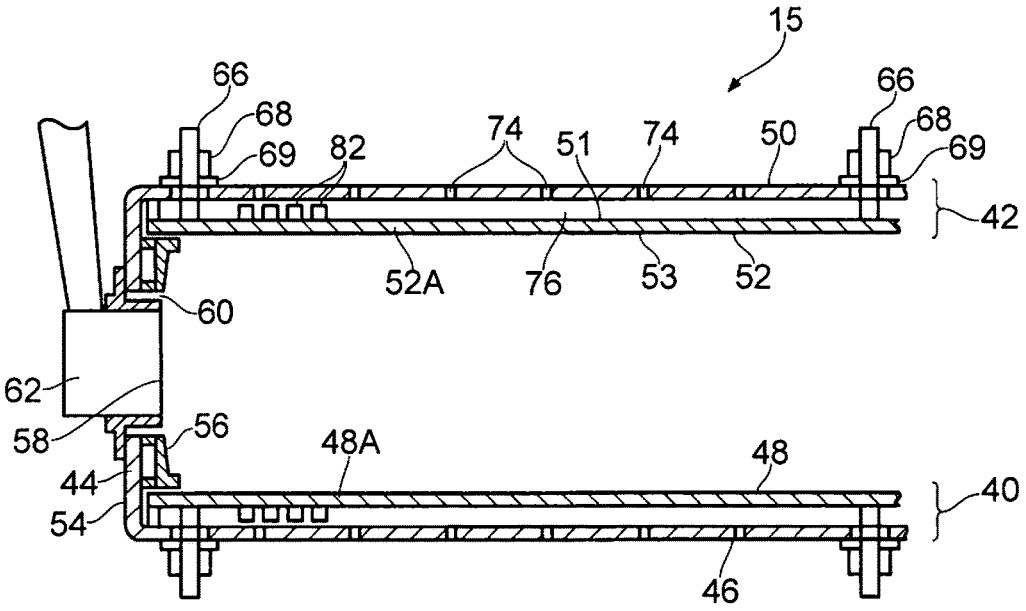
FIG. 2 is an enlarged cross-sectional view of a combustion chamber according to the present disclosure.

The combustion chamber 15, as shown more clearly in FIGS. 2 is an annular combustion chamber and comprises a radially inner annular wall structure 40, a radially outer annular wall structure 42 and an annular upstream end wall structure 44. The radially inner annular wall structure 40 comprises a first annular wall 46 and a second annular wall 48 and the radially outer annular wall structure 42 comprises a third annular wall 50 and a fourth annular wall 52. The upstream end of the first annular wall 46 is secured to the annular upstream end wall structure 44 and the upstream end of the third annular wall 50 is secured to the annular upstream end wall structure 44. The second annular wall 48 comprises a plurality of circumferentially arranged tiles 48A and the tiles 48A are spaced radially outwardly from and supported by the first annular wall 46. The fourth annular wall 52 comprises a plurality of circumferentially arranged tiles 52A and the tiles 52A are spaced radially inwardly from and supported by the third annular wall 50. The annular upstream end wall structure 44 comprises an annular upstream end wall 54 and a plurality of heat shields 56. The heat shields 56 are positioned downstream of and are supported by the annular upstream end wall 54.

The annular combustion chamber 15 also has a plurality of fuel injectors 62 and the fuel injectors 62 are arranged to supply fuel into the annular combustion chamber 15 during operation of the gas turbine engine 10. Each fuel injector 62 locates in a corresponding set of aligned apertures 58 and 60 in the annular upstream end wall 54 and an associated heat shield 56. The annular combustion chamber 15 may be a lean burn combustion chamber comprising lean burn fuel injectors. Each lean burn fuel injector comprises a pilot fuel injector and a main fuel injector. The main fuel injector is arranged coaxially around the pilot fuel injector. The lean burn fuel injectors preferably comprise a prefilming pilot fuel injector provided between inner and outer air swirlers and a prefilming main fuel injector provided between inner and outer air swirlers. An additional air swirler may be provided coaxially between the outer air swirler of the pilot fuel injector and the inner air swirler of the main fuel injector.

Figure 3:
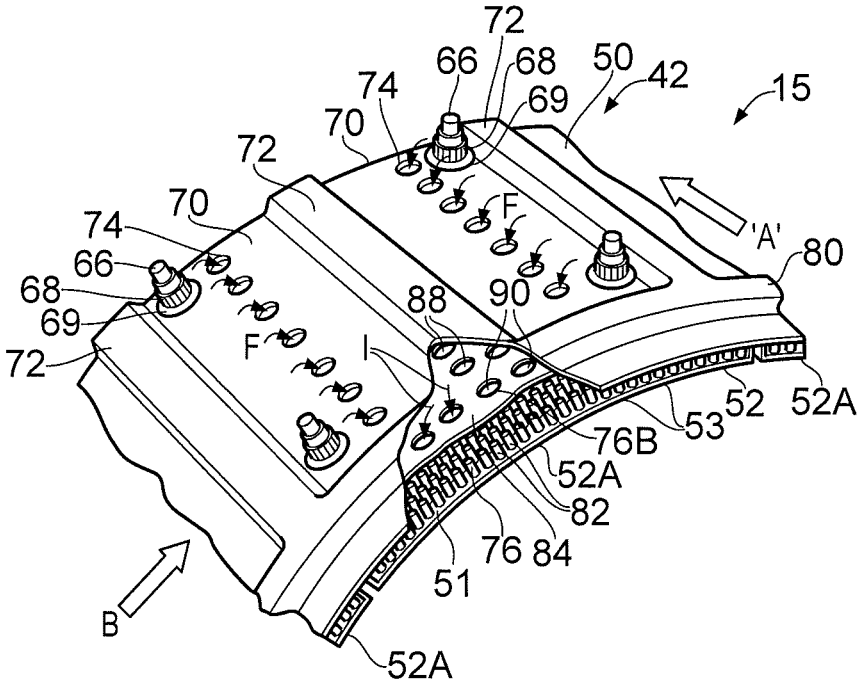
FIG. 3 is a perspective view of a portion of a wall structure of a combustion chamber according to the present disclosure.
Figure 4:
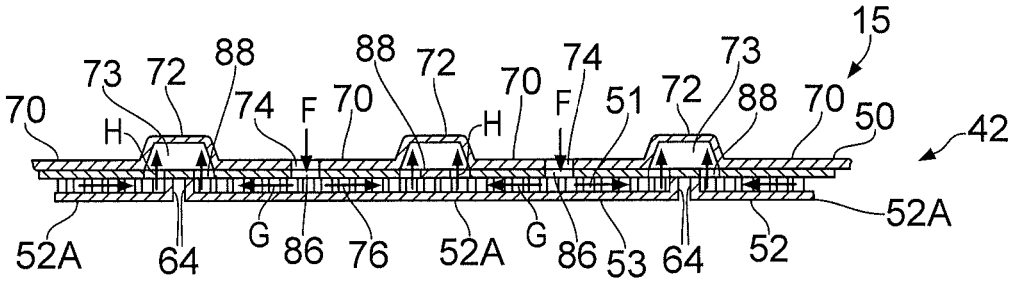
FIG. 4 is an enlarged cross-sectional view of the wall structure of a combustion chamber in the direction of arrow A in FIG. 3.
Figure 5:
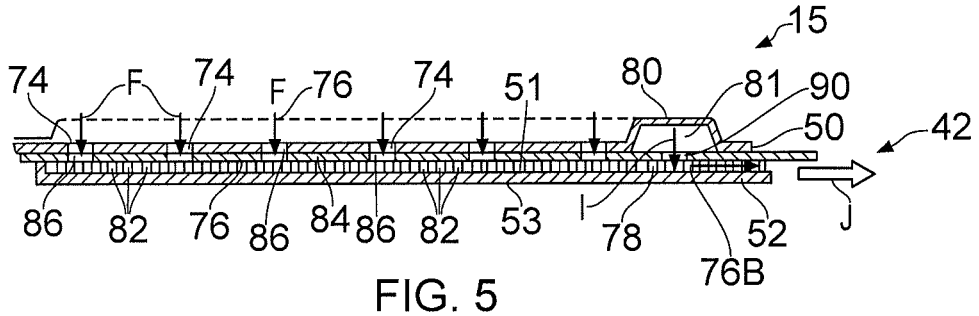
FIG. 5 is an enlarged cross-sectional view of the wall structure of a combustion chamber in the direction of arrow B in FIG. 3.

A combustion chamber 15 according to the present disclosure is shown more clearly in FIGS. 3 to 5 and the radially outer annular wall structure 42 comprises the third annular wall 50 and the fourth annular wall 52 spaced radially from the third annular wall 50. The third annular wall 50 is corrugated and has axially extending grooves 70 and axially extending ridges 72, the grooves 70 and ridges 72 alternate circumferentially around the third annular wall 50. Each groove 70 in the third annular wall 50 has a plurality of axially spaced apertures 74 extending through the third annular wall 50 to supply coolant into a space 76 between the third annular wall 50 and the fourth annular wall 52 and each axially extending ridge 72 defines a collection manifold 73 to collect coolant from the space 76 between the third annular wall 50 and the fourth annular wall 52. The fourth annular wall 52 extends the full length of the combustion chamber 15 and the fourth annular wall 52 has a first surface 51 facing the third annular wall 50 and a second surface 53 facing away from the third annular wall 50. The fourth annular wall 52 has a circumferentially extending wall 78 extending from the first surface 51 of the fourth annular wall 52 towards and contacting the third annular wall 50 and the circumferentially extending wall 78 is positioned adjacent to and spaced from the downstream end of the fourth annular wall 52. The circumferentially extending wall 78 extends all the way around the annular combustion chamber 15, e.g. through 360°. The third annular wall 50 has a circumferentially extending ridge 80 positioned adjacent to and spaced from the downstream end of the third annular wall 50 and at least some of, preferably all of, the circumferentially extending ridge 80 is positioned downstream of the circumferentially extending wall 78. The circumferentially extending ridge 80 extends all the way around the annular combustion chamber 15, e.g. through 360°. The circumferentially extending ridge 80 defines an annular supply manifold 81 to supply coolant to the space 76B between the third annular wall 50 and the fourth annular wall 52 downstream of the circumferentially extending wall 78. The axially extending ridges 72 intersect the circumferentially extending ridge 80 to supply coolant from the collection manifolds 73 to the annular supply manifold 81. The space 76B between the third annular wall 50 and the fourth annular wall 52 downstream of the circumferentially extending wall 78 is arranged to discharge a film of coolant from the downstream end of the fourth annular wall 52. The space 76B between the third annular wall 50 and the fourth annular wall 52 downstream of the circumferentially extending wall 78 is arranged to discharge a film of coolant from the downstream end of the fourth annular wall 52 onto a combustion chamber discharge nozzle (not shown).

As mentioned previously the fourth annular wall 52 comprises a plurality of circumferentially arranged tiles 52A and each tile 52A has axially extending edge walls 64 which extend radially from the first surface 51 of the tiles 52A of the fourth annular wall 52 towards the first annular wall 46. The axially extending edge walls 64 of each tile 52A are circumferentially aligned with corresponding axially extending ridges 72 on the third annular wall 50. The centre of each tile 52A is circumferentially aligned with an axially extending ridge 72 on the third annular wall 50 in this example. Each tile 52A has a plurality of studs 66, which extend radially outwardly from the tile 52A, to secure the tile 52A to the third annular wall 50. A washer 69 and a nut 68 are provided for each stud 66 and each nut 68 is threaded onto its associated stud 66 to secure the tile 52A onto the third annular wall 50. Alternatively the tiles 52A may have threaded bosses (not shown) which extend through apertures in the third annular wall and a spacer and a bolt are provided for each boss and each bolt is threaded into its associated boss to secure the tile 52A onto the third annular wall 50. The tile 52A may other suitable arrangements to secure the tile 52A onto the third annular wall 50.

The apertures 74 in the third annular wall 50 may be circular holes as shown or axially extending slots. The tiles 52A of the fourth annular wall 52 are provided with a plurality of pedestals 82 which extending radially outwardly from the first surface 51 towards the third annular wall 50. The pedestals 82 may be circular, as shown, or other suitable shape, e.g. square, rectangular or triangular, in cross-section. Pedestals 82 are provided upstream of the circumferentially extending wall 78 and pedestals 82 are provided downstream of the circumferentially extending wall 78 in this example.

The tiles 52A may be manufactured by casting or by additive layer manufacture and the additive layer manufacture may comprise direct laser deposition or laser powder bed deposition. The third annular wall 50 and the tiles 52A of the second annular 52 may be formed from a suitable metal, for example a superalloy, e.g. a cobalt superalloy, an iron superalloy or a nickel superalloy.

In one example each tile 52A has a circumferential dimension of approximately 100 mm such that the coolant, air, flows through approximately 25 mm from the apertures 74 in the third annular wall 50 to the axially extending collection manifolds 73 defined by an axially extending ridge 72 and each tile 52A has an axial length of approximately 150 mm. The pedestals 82 are arranged in a dense pedestal array.

In operation the coolant, air, F is supplied through the apertures 74 in the grooves 70 of the third annular wall 50 into the space 76 between the third annular wall 50 and the tiles 52A of the fourth annular wall 52. The coolant, air, G flows generally circumferentially in the space 76 between the third annular wall 50 and the tiles 52A of the fourth annular wall 52 from the apertures 74 in opposite circumferential directions towards the adjacent ridges 72 in the third annular wall 50. The coolant, air, G flows circumferentially over the first surface 51 of the tiles 52A and around the pedestals 82 to cool the tiles 52A of the fourth annular wall 52. The coolant, air, H then flows radially outwardly from space 76 between the third annular wall 50 and the tiles 52A of the fourth annular wall 52 into the axially extending collection manifolds 73 defined by the axially extending ridges 72. The coolant, air, then flows in an axially downstream direction through and along the axially extending collection manifolds 73 to the circumferentially extending manifold 81 defined by the circumferentially extending ridge 80. The coolant, air, I then flows radially inwardly from the circumferentially extending manifold 81 into the space 76B between the third annular wall 50 and the tiles 52A of the fourth annular wall 52 downstream of the circumferentially extending wall 78. The coolant, air, then flows axially downstream over the first surface 51 of the tiles 52A and around the pedestals 82 to cool the tiles 52A of the fourth annular wall 52 and the coolant, air, J is then discharged from the downstream ends of the tiles 52A to flow over the combustion chamber discharge nozzle.

The dense pedestal array in FIGS. 3 to 5 is able to remove 12 $Kw/m^2/K$ and this is sufficient to cool the tiles 52A in a lean burn combustion chamber without the need for a film of coolant on the hot surface of the tiles 52A. However, the level of cold side heat removal from the tiles 52A in the vicinity of the studs 66 may be less than 12 Kw/m$^2$/K and the studs 66 may be hotter than preferred and the service life of the tiles 52A may be limited, for the arrangement in FIGS. 3 to 5.

The radially outer annular wall structure 42 may comprise a further annular wall 84 positioned between the third annular wall 50 and the fourth annular wall 52. The further annular wall 84 abuts the third annular wall 50. The further annular wall 84 has a plurality of apertures 86 extending through the further annular wall 84 and each aperture 86 is aligned with a corresponding aperture 74 in the third annular wall 50 to supply coolant into the space 76 between the third annular wall 50 and the fourth annular wall 52. The further annular wall 84 defines the collection manifolds 73 with the axially extending ridges 72 of the third annular wall 50. The further annular wall 84 has a plurality of apertures 88 to supply coolant from the space 76 between the third annular wall 50 and the fourth annular wall 52 into the collection manifold 73. The further annular wall 84 defines the annular supply manifold 81 with the circumferentially extending ridge 80 of the third annular wall 50 and the further annular wall 84 has a plurality of apertures 90 to supply coolant from the annular supply manifold 81 to the space 76B between the third annular wall 50 and the fourth annular wall 50 downstream of the circumferentially extending wall 78.

The grooves 70 are arcuate and are arranged on a common circle and the ridges 72 extend radially outwardly from the grooves 70 and the ridges 72 are generally top hat shape in cross-section.

Figure 6:
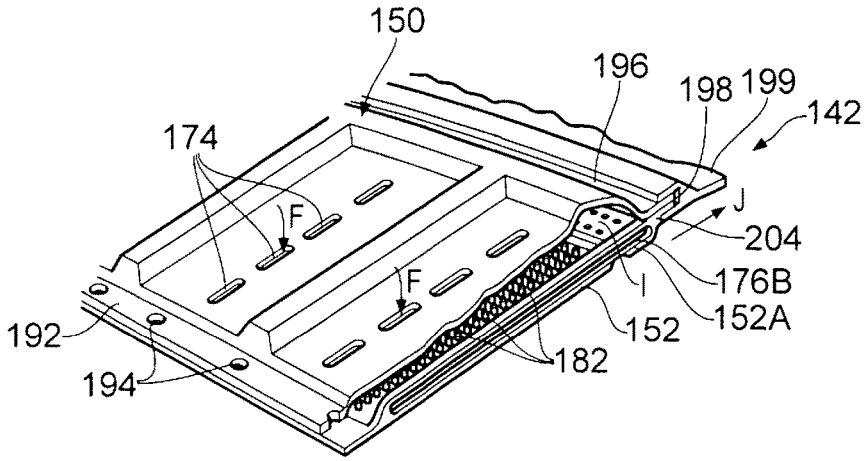
FIG. 6 is a perspective view of a portion of another wall structure of a combustion chamber according to the present disclosure.
Figure 7:
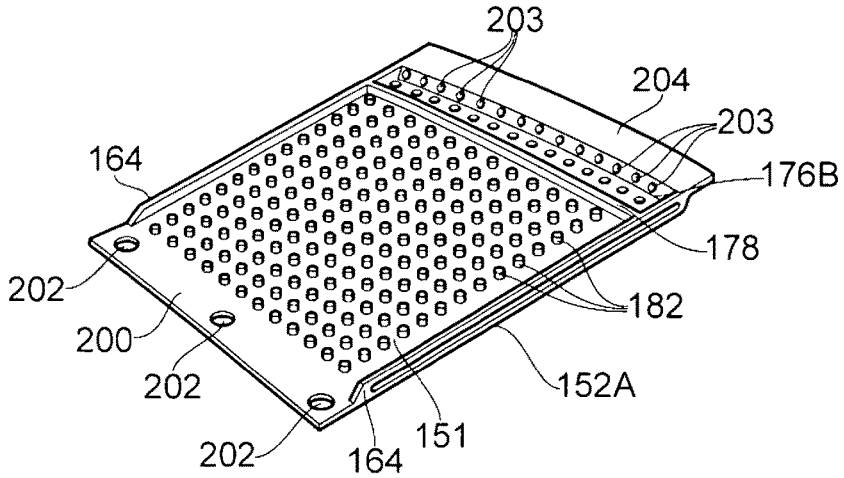
FIG. 7 is a perspective view of a tile for the wall structure of a combustion chamber shown in FIG. 6.

Another combustion chamber according to the present disclosure is shown in FIGS. 6 and 7. The combustion chamber in FIGS. 6 and 7 is similar to that shown in FIGS. 3 to 5 and the radially outer annular wall structure 142 comprises a third annular wall 150 and a fourth annular wall 152 and the fourth annular wall 150 comprises a plurality of circumferentially arranged tiles 152A. Each tile 152A has a plurality of circumferentially spaced apertures 202 at the upstream end 200 of the tile 152A to secure the tile 152A between the upstream end 192 of the third annular wall 150 and an upstream wall 54 of the combustion chamber 15. The upstream end 192 of the third annular wall 150 has a plurality of circumferentially spaced apertures 194 and the tiles 152A are secured between the upstream end 192 of the third annular wall 150 and the upstream wall 54 of the combustion chamber 15 using a plurality of fasteners, e.g. nuts and bolts etc. The downstream end 204 of each tile 152A and the downstream end 196 of the third annular wall 150 locate in an annular slot 198 in a combustion chamber discharge nozzle 199 or other suitable static structure of the gas turbine engine 10. The tiles 152A are therefore clamped at their upstream and downstream ends 200 and 204 to the third annular wall 150. The space 176B downstream of the circumferentially extending wall 178 is arranged to discharge the coolant, air, as a film using effusion apertures 203. The axially extending edge walls 164 which extend radially from the first surface 151 of the tiles 152A are provided with sealing strips between circumferentially adjacent tiles 152A to prevent coolant leakage. Alternatively the downstream end of each tile may have a hook (not shown) to locate in an annular slot (not shown) in the first annular wall to secure the downstream end of the tile to the first annular wall.

The apertures 174 in the third annular wall 150 may be circular holes or axially extending slots as shown. The tiles 152A of the fourth annular wall 152 are provided with a plurality of pedestals 182 which extend radially outwardly from the first surface 151 towards the third annular wall 150. The pedestals 182 may be circular, as shown, or other suitable shape, e.g. square, rectangular or triangular, in cross-section. The pedestals 182 are only provided upstream of the circumferentially extending wall 178 in this example.

The tiles 152A may be manufactured by casting or by additive layer manufacture and the additive layer manufacture may comprise direct laser deposition or laser powder bed deposition. The tiles 152A are easier to produce by additive layer manufacture than tiles 52A because the tiles 152A do not have studs which are difficult and costly to manufacture by additive layer manufacture. The third annular wall 150 and the tiles 152A of the second annular 152 may be formed from a suitable metal, for example a superalloy, e.g. a cobalt superalloy, an iron superalloy or a nickel superalloy.

The radially outer annular wall structure 142 in FIGS. 6 and 7 operates in substantially the same manner as the radially outer annular wall structure 42 in FIGS. 3 to 5.

The dense pedestal array is able to remove 12 Kw/m$^2$/K and this is sufficient to cool the tiles in a lean burn combustion chamber without the need for a film of coolant on the hot surface of the tiles. However, the tiles in the arrangement in FIGS. 6 and 7 do not have studs and the service life of the tiles in the arrangement of FIGS. 6 and 7 may be longer than the service life of the tiles in the arrangement in FIGS. 3 to 5.

Figure 8:
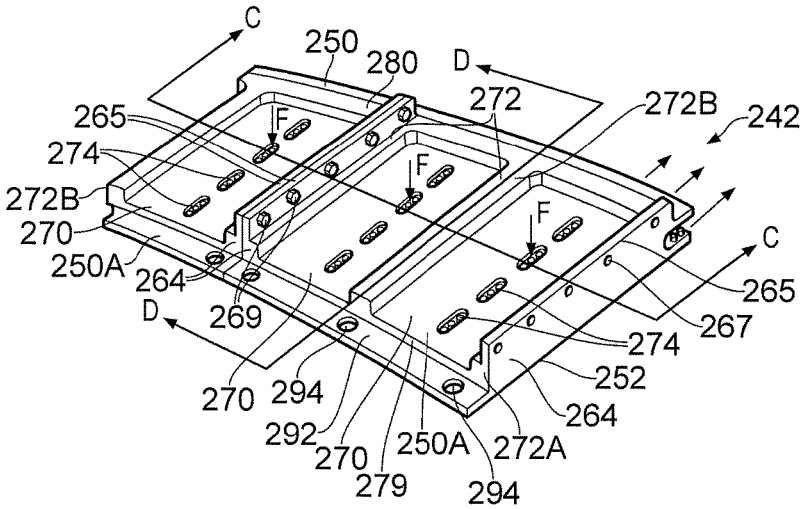
FIG. 8 is a perspective view of a portion of a further wall structure of a combustion chamber according to the present disclosure.
Figure 9:
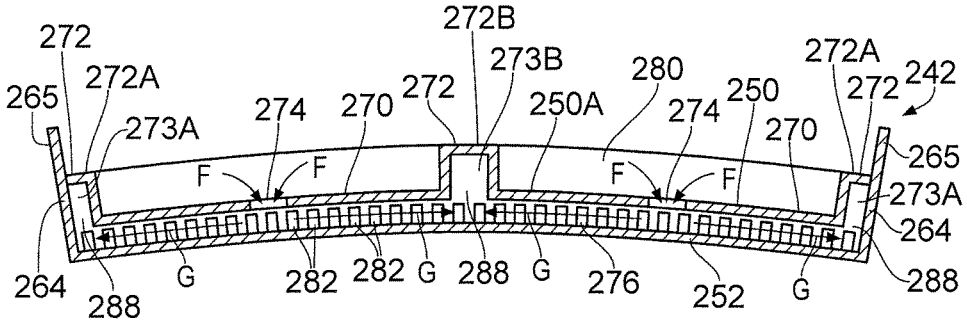
FIG. 9 is an enlarged cross-sectional view of the wall structure of a combustion chamber in the direction of arrow C in FIG. 8.
Figure 10:
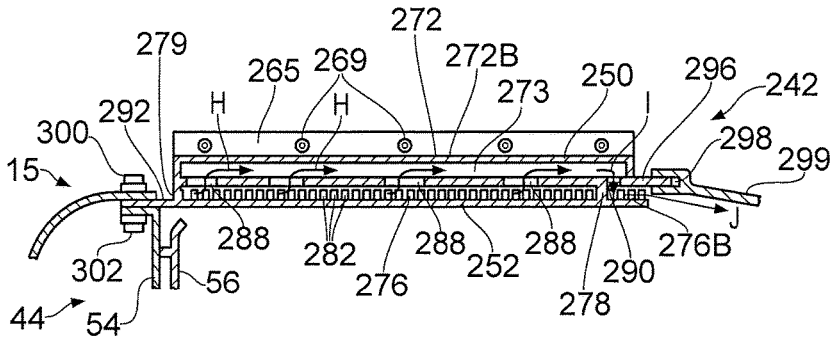
FIG. 10 is an enlarged cross-sectional view of the wall structure of a combustion chamber in the direction of arrow D in FIG. 8.

An additional combustion chamber according to the present disclosure is shown in FIGS. 8 to 10. The radially outer annular wall structure 242 in FIGS. 8 to 10 is similar to that shown in FIGS. 3 to 5 and comprises a third annular wall 250 and a fourth annular wall 252 and the third annular wall 250 again comprises axially extending grooves 270 and axially extending ridges 272. However the radially outer annular wall structure 242 differs in that the third and fourth annular walls 250 and 252 comprise a plurality of circumferentially arranged segments 250A. Each segment 250A comprises a portion of the third annular wall 250 and a portion of the fourth annular wall 252. Each segment 250A has axially extending edge walls 264 extending radially from the portion of the fourth annular wall 252 to the portion of the third annular wall 250 and the portion of the third annular wall 250, the portion of the fourth annular wall 252 and the axially extending edge walls 264 are integral, e.g. one piece, and the circumferentially adjacent segments 250A are secured together. In this example each segment 250A comprises an axially extending ridge 272B, to define an axially extending collection manifold 273B, in the centre of the portion of the third annular wall 250 of the segment 250A. The axially extending edge walls 264 of each segment 250A are circumferentially aligned with the centres of corresponding axially extending ridges 272A on the third annular wall 250 to define two axially extending collections manifolds 273A one in each of the corresponding axially extending ridges 272A. Thus, the axially extending collection manifolds 273A at the circumferential ends of each segment 250A are about half the circumferential width of the axially extending collection manifold 273B in the centre of the segment 250A. Thus the axially extending edge walls 264 divide each of the axially extending ridges 272A into two axially extending collection manifolds 273A. The centre of each segment 250A is aligned with an axially extending ridge 272B on the third annular wall 250. The radially extending walls 264 of each segment 250A extend radially beyond the ridge 272A to form axially extending flanges 265 and the flanges 265 of adjacent segments 250A are secured together. The flanges 265 of the segments 250A are provided with apertures 267 and the flanges 267 of adjacent segments 250A are secured together with suitable fasteners, e.g. nuts and bolts 269 and suitable seals may be provided between the adjacent segments 250A. Alternatively the segments 250A may be welded, brazed or bonded together. FIGS. 9 and 10 show a plurality of apertures 288 to supply the coolant, air, from the space 276 between the portion of the third annular wall 250 and the portion of the fourth annular wall 252 of each segment 250A to the axially extending collection manifolds 273A and 273B and a plurality of apertures 290 to supply the coolant from the annular supply manifold 280 to the space 276B between the portion of the third annular wall 250 and the portion of the fourth annular wall 252 of each segment 250A downstream of a circumferentially extending wall 278. The circumferentially extending wall 278 extends radially between and is integral with the portion of the third annular wall 250 and the portion of the fourth annular wall 252.

The segments 250A may be manufactured by additive layer manufacture. The additive layer manufacture may comprise direct laser deposition or laser powder bed deposition. The segments 250A may be formed from a suitable metal, for example a superalloy, e.g. a cobalt superalloy, an iron superalloy or a nickel superalloy.

Each segment 250A has a circumferentially extending wall 279 which extends radially between and is integral with the portion of the third annular wall 250 and the portion of the fourth annular wall 252 at the upstream end of the segment 250A. The upstream end of each segment 250A has a flange 292 extending in an upstream direction and the flange 292 has a plurality of apertures 294 to secure the segment 250A to an upstream end wall 54 of the combustion chamber 15. Each segment 250A is secured to the upstream end wall 54 of the combustion chamber 15 with suitable fasteners, e.g. nuts and bolts 300 and 302 which pass through the apertures 294 in the flange 292 and corresponding apertures in the upstream end wall 54 of the combustion chamber 15. The downstream end 296 of each segment 250A locates in an annular slot 298 in a combustion chamber discharge nozzle 299.

The apertures 274 in the third annular wall 250 are axially extending slots, as shown, but may be circular holes. The fourth annular wall 252 has a plurality of pedestals 282 extending from the first surface 251 to the third annular wall 250 and the pedestals 282 are integral with the fourth annular wall 252 and the third annular wall 250. The pedestals 282 may be circular, square, rectangular or triangular in cross-section. The portion of the first annular wall 250, the portion of the second annular wall 252, the axially extending edge walls 264, the circumferentially extending wall 278, the circumferentially extending wall 279 and the pedestals 282 are integral, e.g. a single piece. Thus, each segment 250A comprises a box structure, which is inherently stiff, and the box structure comprises the portion of the third annular wall 250, the portion of the fourth annular wall, 252, the radially extending walls 264, the circumferentially extending wall 278 and the circumferentially extending wall 279.

The radially outer annular wall structure 242 in FIGS. 8 to 10 operates in substantially the same manner as the radially outer annular wall structure 42 in FIGS. 3 to 5.

The dense pedestal array is able to remove 12 $Kw/m^2/K$ and this is sufficient to cool the segments in a lean burn combustion chamber without the need for a film of coolant on the hot surface of the segments. The segments in the arrangement of FIGS. 8 to 10 have an additional advantage. A first advantage is that there is no need to have a metering pressure drop across the third annular wall because there is no internal flow leakage over the tops of the pedestals. Hence the pressure drop through the pedestal arrays may be increased allowing either even more heat removal or alternatively a greater circumferential distance, greater than 25 mm, between the apertures in the third annular wall to the axially extending collection manifold defined by an axially extending ridge. A second advantage is that there are no leakage paths for the coolant, air, either between the segments or over the tops of the pedestals and hence the performance of this arrangement should be very reliable in service.

The third annular wall of the embodiment in FIGS. 3 to 5 and FIGS. 6 to 7 may be manufactured by additive layer manufacture. The additive layer manufacture may comprise direct laser deposition or laser powder bed deposition and in particular using the method described in our published European patent application EP2762252A1.

Figure 11:
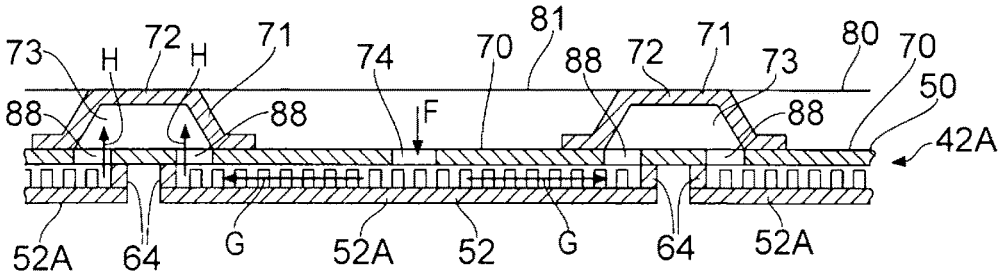
FIG. 11 is an alternative enlarged cross-sectional view of the wall structure of a combustion chamber in the direction of arrow A in FIG. 3.

Another combustion chamber according to the present disclosure is shown in FIG. 11. The radially outer annular wall structure 42A is similar to that shown in FIGS. 3 to 5 and comprises a third annular wall 50 and a fourth annular wall 52 and the fourth annular wall 50 comprises a plurality of circumferentially arranged tiles 52A. The wall structure 42A differs in that the third annular wall 50 is constructed from an annular wall and a plurality of separate top hat section metal sheets 71 secured to the third annular wall 50 at a plurality of angularly spaced positions to form the axially extending ridges 72, to define the axially extending collection manifolds 73, and a single separate top hat section metal sheet 81 is secured to the third annular wall 50, to form the circumferentially extending ridge 80 and to define the annular supply manifold 81. The top hat section metal sheets are fastened to the third annular wall 50 by welding, brazing, bonding, riveting or fastening etc. The third annular wall 50 is provided with a plurality of apertures 88 extending there-through underneath each of axially extending top hat section metal sheets 71 and a plurality of apertures 90 extending there-through underneath the circumferentially extending top hat section metal sheet 81. The third annular wall 50, the tiles 52A of the fourth annular wall 52 and the top hat section metal sheets 71 and 81 may be formed from a suitable metal, for example a superalloy, e.g. a cobalt superalloy, an iron superalloy or a nickel superalloy.

In all of the embodiments described it may be beneficial to provide a thermal barrier coating on the hot surfaces of the tiles or the hot surfaces of the segments. The thermal barrier coating may comprise bond coating and a ceramic coating. The bond coating may be a MCrAlY or an aluminide coating, where M is one or more of cobalt, iron and nickel, Cr is chromium, Al is aluminium and Y is one or more of yttrium, ytterbium, lanthanum or other rare earth elements. The ceramic coating may be zirconia or stabilised zirconia, e.g. yttria stabilised zirconia.

The advantage of the present disclosure is that there is no film of coolant, film of air, on the hot side of the second annular wall, tiles of the second annular wall, to quench the combustion reactions in a lean burn combustion chamber and hence the combustion efficiency is not reduced and the fuel burn is not increased for the gas turbine engine.

Although the present disclosure has referred to the use of a plurality of axially spaced apertures between each pair of circumferentially adjacent axially extending collection manifolds it may be possible to provide a single aperture between each pair of circumferentially adjacent axially extending collection manifolds if it provides sufficient coolant, air, into the space between the third annular wall and the fourth annular wall and the coolant, air, is supplied and distributed axially uniformly along the axial length of the annular combustion chamber, e.g. the single aperture may be a slot.

Although the present disclosure has been described with reference to the radially outer annular wall structure 42 comprising a third annular wall 50 and the fourth annular wall 52, the present disclosure is equally applicable to a radially inner annular wall structure 40 comprising the first annular wall 46 and the second annular wall 48.

Thus, in general the present disclosure is applicable to a first annular wall of an annular combustion chamber and a second annular wall which is spaced radially from the first annular wall. The first annular wall may be an outer annular wall of an annular combustion chamber and the second annular wall is spaced radially inwardly from the first annular wall. Alternatively the first annular wall may be an outer annular wall of an annular combustion chamber and the second annular wall is spaced radially inwardly from the first annular wall. The first annular wall may be an outer annular wall of a tubular combustion chamber and the second annular wall is spaced radially inwardly from the first annular wall.

Although the combustion chamber has been described with reference to the use in a turbofan gas turbine engine it also suitable for use in a turbojet gas turbine engine, a turbo-shaft gas turbine engine or a turbo-propeller gas turbine engine.

Although the combustion chamber has been described with reference to the use in an aero gas turbine engine it is also suitable for use in a marine gas turbine engine, an industrial gas turbine engine or an automotive gas turbine engine.

The invention claimed is:

1. A combustion chamber comprising a first annular wall and a second annular wall spaced radially from the first annular wall, a plurality of circumferentially spaced axially extending coolant collection manifolds to collect coolant from a space between the first annular wall and the second annular wall, a plurality of apertures extending through the first annular wall to supply coolant into the space between the first annular wall and the second annular wall, at least one aperture being positioned between each pair of circumferentially adjacent axially extending coolant collection manifolds, the second annular wall extending the full length of the combustion chamber, the second annular wall having a circumferentially extending wall extending towards and contacting the first annular wall, the circumferentially extending wall being positioned adjacent to and spaced from a downstream end of the second annular wall, an annular supply manifold to supply coolant to a space between the first annular wall and the second annular wall downstream of the circumferentially extending wall, the axially extending coolant collection manifolds being arranged to supply coolant to the annular supply manifold, and the space between the first annular wall and the second annular wall downstream of the circumferentially extending wall being arranged to discharge a film of coolant from the downstream end of the second annular wall.

2. A combustion chamber as claimed in claim 1, wherein the plurality of apertures are a plurality of rows of axially spaced apertures extending through the first annular wall to supply coolant into the space between the first annular wall and the second annular wall; and at least one row of axially spaced apertures, including the at least one aperture, being positioned between each pair of circumferentially adjacent axially extending coolant collection manifolds.

3. A combustion chamber as claimed in claim 1 wherein the first annular wall being corrugated and having axially extending grooves and axially extending ridges, the axially extending grooves and axially extending ridges alternating circumferentially around the first annular wall, each axially extending groove in the first annular wall having a plurality of axially spaced apertures extending through the first annular wall to supply coolant into the space between the first annular wall and the second annular wall, each axially extending ridge defining a respective one of the plurality of collection manifolds to collect coolant from the space between the first annular wall and the second annular wall, the second annular wall having a first surface facing the first annular wall and a second surface facing away from the first annular wall, the circumferentially extending wall of the second annular wall extending from the first surface of the second annular wall towards and contacting the first annular wall, the first annular wall having a circumferentially extending ridge positioned adjacent to and spaced from the downstream end of the first annular wall, the circumferentially extending ridge being positioned downstream of the circumferentially extending wall, the circumferentially extending ridge defining the annular supply manifold to supply the coolant to the space between the first annular wall and the second annular wall downstream of the circumferentially extending wall, the axially extending ridges intersecting the circumferentially extending ridge to supply coolant from the collection manifolds to the annular supply manifold.

4. A combustion chamber as claimed in claim 3 wherein a third annular wall being positioned between the first annular wall and the second annular wall, the third annular wall abutting the first annular wall, the third annular wall having a first plurality of apertures extending through the third annular wall and aligned with a corresponding aperture of the plurality of apertures in the first annular wall to supply coolant into the space between the first annular wall and the second annular wall, the third annular wall defining the collection manifolds with the axially extending ridges of the first annular wall, the third annular wall having a second plurality of apertures to supply coolant from the space between the first annular wall and the second annular wall into the collection manifolds, the third annular wall defining the annular supply manifold with the circumferentially extending ridge of the first annular wall and the third annular wall having a third plurality of apertures to supply coolant from the annular supply manifold to the space between the first annular wall and the second annular wall downstream of the circumferentially extending wall.

5. A combustion chamber as claimed in claim 1 wherein the space between the first annular wall and the second annular wall downstream of the circumferentially extending wall being arranged to discharge a film of coolant from the downstream end of the second annular wall onto a combustion chamber discharge nozzle.

6. A combustion chamber as claimed in claim 1 wherein the second annular wall comprising a plurality of circumferentially arranged tiles and each tile has axially extending edge walls extending from a first surface of the second annular wall towards the first annular wall.

7. A combustion chamber as claimed in claim 6 wherein the axially extending edge walls of each tile being circumferentially aligned with corresponding axially extending ridges on the first annular wall.

8. A combustion chamber as claimed in claim 7 wherein the center of each tile being aligned with an axially extending ridge on the first annular wall.

9. A combustion chamber as claimed in claim 6 wherein each tile having a plurality of studs to secure the tile to the first annular wall.

10. A combustion chamber as claimed in claim 6 wherein the tiles being manufactured by a method selected from the group consisting of casting and additive layer manufacture.

11. A combustion chamber as claimed in claim 6 wherein each tile having apertures at an upstream end of the tile to secure the tile between the upstream end of the first annular wall and an upstream wall of the combustion chamber.

12. A combustion chamber as claimed in claim 11 wherein a downstream end of each tile and the downstream end of the first annular wall locate in an annular slot in a combustion chamber discharge nozzle.

13. A combustion chamber as claimed in claim 1 comprising a plurality of circumferentially arranged segments, each segment comprising a portion of the first annular wall and a portion of the second annular wall, each segment has axially extending edge walls extending radially from the portion of the first annular wall to the portion of the second annular wall, the portion of the first annular wall and the portion of the second annular wall are integral and the segments are secured together.

14. A combustion chamber as claimed in claim 13 wherein the axially extending edge walls of each segment being circumferentially aligned with the centers of corresponding axially extending ridges on the first annular wall to define two collections manifolds in each of the corresponding axially extending ridges.

15. A combustion chamber as claimed in claim 14 wherein the center of each segment being aligned with an axially extending ridge on the first annular wall.

16. A combustion chamber as claimed in claim 14 wherein the axially extending edge walls of each segment extending radially beyond the corresponding axially extending ridges to form axially extending flanges, and the flanges of adjacent segments are secured together.

17. A combustion chamber as claimed in claim 16 wherein the flanges of adjacent segments being secured together with fasteners.

18. A combustion chamber as claimed in claim 13 wherein each segment having apertures at an upstream end of the segment to secure the segment to an upstream wall of the combustion chamber and each segment being secured to the upstream wall of the combustion chamber with fasteners.

19. A combustion chamber as claimed in claim 13 wherein a downstream end of each segment located in an annular slot in a combustion chamber discharge nozzle.

20. A combustion chamber as claimed in claim 13 wherein the segments being manufactured by additive layer manufacture.

21. A combustion chamber as claimed in claim 1 wherein the plurality of apertures in the first annular wall are axially extending slots.

22. A combustion chamber as claimed in claim 1 wherein the second annular wall having a plurality of pedestals extending from a first surface towards the first annular wall.

23. A combustion chamber as claimed in claim 1 wherein the first annular wall being an inner annular wall of an annular combustion chamber and the second annular wall is spaced radially outwardly from the first annular wall.

24. A combustion chamber as claimed in claim 1 wherein the first annular wall being an outer annular wall of an annular combustion chamber and the second annular wall is spaced radially inwardly from the first annular wall.

* * * * *